US012297068B2

(12) United States Patent
Hirtl et al.

(10) Patent No.: US 12,297,068 B2
(45) Date of Patent: May 13, 2025

(54) WINDING DEVICE

(71) Applicant: SSM Schärer Schweiter Mettler AG, Wädenswil (CH)

(72) Inventors: Alexander Hirtl, Reichenburg (CH); Roman Philipp, Aadorf (CH)

(73) Assignee: SSM Scharer Schweiter Mettler AG, Wadenswil (CH)

( * ) Notice: Subject to any disclaimer, the term of this patent is extended or adjusted under 35 U.S.C. 154(b) by 828 days.

(21) Appl. No.: 17/399,325

(22) Filed: Aug. 11, 2021

(65) Prior Publication Data

US 2022/0048724 A1 Feb. 17, 2022

(30) Foreign Application Priority Data

Aug. 13, 2020 (CH) ..... 01015/20

(51) Int. Cl.
*B65H 54/52* (2006.01)
*B65H 54/547* (2006.01)

(52) U.S. Cl.
CPC ..... *B65H 54/52* (2013.01); *B65H 54/547* (2013.01); *B65H 2701/31* (2013.01)

(58) Field of Classification Search
CPC .. B65H 54/52; B65H 54/547; B65H 2701/31; B65H 63/082
See application file for complete search history.

(56) References Cited

U.S. PATENT DOCUMENTS 3,241,778 A * 3/1966 Bourgeas ..... B65H 54/52 242/486.4
3,934,830 A * 1/1976 Grau ..... B65H 54/52 242/485.9
5,029,762 A * 7/1991 Behrens ..... B65H 54/52 242/474.5
5,033,685 A * 7/1991 Busenhart ..... B65H 54/52 242/470

(Continued)

FOREIGN PATENT DOCUMENTS

DE 94 84 93 C 8/1956
DE 25 13 981 A1 10/1976

(Continued)

OTHER PUBLICATIONS

Swiss Search Report, Nov. 3, 2020.

*Primary Examiner* — Sang K Kim
*Assistant Examiner* — Nathaniel L Adams
(74) *Attorney, Agent, or Firm* — Dority & Manning, P.A.

(57) ABSTRACT

A winding device for winding a thread onto a bobbin tube to form a bobbin includes a machine frame, a controller, and a support roller rotatably mounted in the machine frame to support the bobbin tube or the bobbin. A winding mandrel holds the bobbin tube and is pivotally held on a pivot lever that is rotatably mounted on a rotary axis in the machine frame. The pivot lever includes a first and a second lever arm, wherein the winding mandrel is provided on the first lever arm. A linear drive is provided on the second lever arm to move the pivot lever about the rotary axis, wherein the (Continued)

linear drive is connected to the second lever arm via a push rod and an axle bolt and is pivotally attached to the machine frame via a holder. A force measurement device is arranged between the axle bolt and the holder.

12 Claims, 1 Drawing Sheet

(56) References Cited

U.S. PATENT DOCUMENTS

| | | | | |
|---|---|---|---|---|
| 2013/0284848 | A1* | 10/2013 | Hashimoto | B65H 54/52 242/477.1 |
| 2020/0087821 | A1* | 3/2020 | Christe | B65H 54/52 |
| 2020/0156898 | A1* | 5/2020 | Christe | B65H 54/52 |

FOREIGN PATENT DOCUMENTS

| | | | | | |
|---|---|---|---|---|---|
| DE | 10 2018 112 796 | A1 | | 12/2019 | |
| EP | 1 820 764 | A2 | | 8/2007 | |
| EP | 2 740 699 | A2 | | 6/2014 | |
| EP | 3575254 | A1 | * | 12/2019 | B65H 54/52 |
| JP | S 6040378 | A | | 3/1985 | |
| JP | 61155147 | A | * | 7/1986 | |
| JP | S 61155147 | A | | 7/1986 | |
| JP | 2000 007 222 | A | | 1/2000 | |
| WO | WO 2019/007729 | A1 | | 1/2019 | |

* cited by examiner

WINDING DEVICE

FIELD OF THE INVENTION

The present invention relates to a device and a method for winding a thread onto a bobbin tube for forming a bobbin, comprising a machine frame and a controller, a support roller rotatably mounted in the machine frame for supporting the bobbin tube, and a winding mandrel for holding the bobbin tube, wherein the winding mandrel is held on a pivot lever which is rotatably mounted on a rotary axis in the machine frame.

BACKGROUND

Winding devices of this type are used in textile machines of various types, for example end spinning machines, rewinding machines, or winding machines. The bobbin or the bobbin tube are rotatably mounted between two holding arms or on a winding mandrel. The two holding arms or the winding mandrel are in turn held in a common pivot arm using a pivot axis. At the beginning of a winding process (a so-called winding cycle), the bobbin tube abuts against a support roller and is set in rotation by a drive, whereby a thread or yarn fed between the support roller and the bobbin tube is wound onto the bobbin tube and a bobbin is formed. Various types of winding tubes in cylindrical or conical shape made of different materials, for example plastics material or paper, are used. The winding tubes can be designed with or without side flanges. During winding, the thread is moved back and forth with a traverse along a longitudinal axis of the bobbin tube, whereby different types of windings are formed in structure and shape. The drive of the bobbin tube takes place directly via a motor which sets at least one of the tube receptacles or the bobbin mandrel in rotation or indirectly via a friction roller arranged parallel to the bobbin tube. The friction roller also serves as a support roller. The friction roller can be designed as a so-called grooved drum. The grooved drum is provided with a yarn guide which is guided in slots by the rotation of the grooved drum in such a way that the thread is moved back and forth. In the tube of a direct drive of the bobbin tube, the traverse of the thread is to be provided by a separate laying unit and a support of the bobbin tube is to be provided by a separate support roller. The thread is clamped between the support roller and the bobbin tube or the thread already on the bobbin tube and is thereby deposited on the bobbin tube.

As a result of the winding process, a diameter of the resulting bobbin increases steadily due to the thread wound onto the bobbin tube. As a result, the distance between the support roller and the longitudinal axis of the bobbin tube increases. Winding devices are known from the prior art which are equipped with a pivot drive for this movement. It is also known that pivot drives can be equipped with an angle measurement, so that a corresponding controller always knows in which position the pivot drive is.

However, the winding process also increases the dead weight of the bobbin that abuts against the support roller or the friction roller. This increases the abutment force acting on a surface of the bobbin. So that this abutment force does not become too great, it is known from the prior art, for example from EP 1 820 764 A2, to use counterweights which keep the abutment forces approximately at a constant level. WO 2019/007729 A1 also discloses a winding device in which the abutment force is measured and regulated by moving the pivot drive. After the winding process has ended, the finished bobbin must be lifted off the support roller or the friction roller in order to be able to remove the bobbin from the holding arms and insert a new bobbin tube. This lifting of the bobbin is achieved by pivoting the bobbin.

The disadvantage of the known designs of the winding devices is that a complex construction and drive technology must be used for moving the bobbin in order to maintain the abutment forces.

SUMMARY OF THE INVENTION

An object of the present invention is therefore to propose a device and a method for winding a thread onto a bobbin, which allow for a simple and inexpensive construction, without having to forego a high quality and uniformity of the bobbins. Additional objects and advantages of the invention will be set forth in part in the following description, or may be obvious from the description, or may be learned through practice of the invention.

The problems are solved by a device and a method having the features described and claimed herein.

A winding device is proposed for winding a thread onto a bobbin tube for forming a bobbin. The winding device comprises a machine frame and a controller, a support roller rotatably mounted in the machine frame for supporting the bobbin tube, and a winding mandrel for holding the bobbin tube, wherein the winding mandrel is held on a pivot lever which is rotatably mounted on a rotary axis in the machine frame. The pivot lever is designed with two lever arms, wherein the winding mandrel for the bobbin tube is provided on a first lever arm and a linear drive for moving the pivot lever about the rotary axis is provided on a second lever arm. The linear drive is connected to the second lever arm using a push rod via an axle bolt and is held in the machine frame so as to be pivotable. A force measurement device is arranged between the axle bolt and the holder of the linear drive in the machine frame. By using a winding mandrel instead of a previously common bobbin frame, the construction of the winding device is significantly simplified. A single pivot lever attached to one side of the winding mandrel is sufficient for storing the winding mandrel. The pivot lever comprises two lever arms, a rotary axis being provided at the point of intersection of the two lever arms, which axis forms a fixed point and is fixedly connected to the machine frame. The linear drive attached to the second lever arm is rotatably attached to the push rod with an axle bolt. At the end of the linear drive opposite the axle bolt, there is another rotatable attachment to the machine frame. By means of the linear drive, the bobbin mandrel is moved toward or away from the support roller with a gear ratio corresponding to the two lever arms.

The force measurement device can be arranged on both sides of the linear drive. When the linear drive is actuated, the winding tube is pressed onto the support roller via the pivot lever. The resulting abutment force can be increased or decreased by moving the linear drive accordingly. Since the force measurement device is provided between the stationary holder of the linear drive and the pivot lever, a force that is directly proportional to the abutment force is measured with the force measurement device. The force measurement device can be designed as a hydraulic or mechanical force measurement device. The force measurement device is advantageously designed as a load cell arranged between the axle bolt and the holder of the linear drive. This allows for a simple and compact design, and a load cell can also be coupled directly to a controller in a simple manner. Various types of so-called force transducers can be used in load cells. For example, the use of force transducers is known in which the force acts on a resilient spring body and deforms it. The deformation of the spring body is converted into a change in electrical voltage by means of strain gauges, the electrical resistance of which changes with the expansion. The electrical voltage and thus the change in strain are registered via a measuring amplifier. This can be converted into a force measurement value due to the resilient properties of the spring body. Bending bars, ring torsion springs, or other designs are used as spring bodies. Piezoceramic elements are used in a further type of load cell. The directional deformation of a piezoelectric material creates microscopic dipoles within the elementary cells of the piezoelectric crystal. The summation of the associated electrical field in all unit cells of the crystal leads to a macroscopically measurable electrical voltage, which can be converted into a force measurement value. Load cells are known from the prior art and are now widely used in force and weight measurement devices. As an alternative to the arrangement of the force measurement device between the axle bolt and the holder of the linear drive, a force measurement can take place directly via the axle bolt. At the same time, the axle bolt is designed to function as a pivotable connection between the holder and the pivot lever as a force-introducing component of a force measurement device.

Preferably, and in order to achieve a further simplification of the construction, the linear drive is connected to the holder via the load cell. The construction of the load cell is provided such that it can be used as part of a holder. In a further embodiment, the load cell can also be attached to the machine frame in a rotatable manner.

The linear drive can be provided as a pneumatic or electric drive. However, it is advantageous if the linear drive is an electric stepper motor with a resolution of less than 0.06 mm per step. Linear drives are known in various designs. However, in order to allow for the most precise possible regulation of the abutment force of the bobbin on the support roller, a linear drive with the smallest possible step size is advantageous. It has been shown that with today's arrangements of the winding devices a step size of less than 0.06 mm is to be preferred. The design of the linear drive is also to be selected in such a way that a manual movement of the pivot lever against the de-energised linear drive is possible. In the event of a malfunction, it may be necessary to manually lift the bobbin off the support roller and it should be possible to do so without a mechanical decoupling of the linear drive.

In a preferred embodiment, a drive for the winding mandrel is arranged on the first lever arm. The additional weight of this drive, which also influences the abutment force of the bobbin tube on the support roller, can be absorbed by the corresponding movement of the linear drive. This direct drive of the winding mandrel instead of an indirect drive of the bobbin with the aid of the support roller allows for a slip-free control of the winding speed. There are also fewer losses in the form of friction and mechanical transmission, which leads to lower energy consumption by the bobbin drive.

A handle with a release button for manually releasing the winding mandrel is advantageously provided on the second lever arm. The bobbin tube is held on the winding mandrel by spreading the winding mandrel. A diameter of the winding mandrel is enlarged by spring force and thus the bobbin tube is clamped. In order not to pull the full bobbin against this spring force from the winding mandrel or to have to push the new bobbin tube onto the winding mandrel against the spring force when replacing a full bobbin with a new bobbin tube, a corresponding release button is provided which releases the spring. As long as the release button is pressed, the bobbin can be pulled off the winding mandrel without resistance. It is also conceivable that when the release button is pressed for the first time, the spring is released and when the release button is pressed a second time, the spring is tensioned or released again. Furthermore, the handle also serves to move the bobbin or the bobbin mandrel manually away from the support roller or toward the support roller without the aid of the linear drive. By applying a slight manual force to the pivot arm or the handle, a torque of resistance of the linear drive can be overcome and the bobbin or the winding mandrel can also be manually brought into the desired position.

Preferably, a stop is provided on the pivot lever which prevents the winding mandrel from abutting against the support roller if the bobbin tube is missing. Depending on the arrangement of the pivot lever, an advantageously adjustable stop is provided on the first or on the second lever arm of the pivot lever. The pivoting movement of the winding mandrel against the support roller until the contact thereof is thereby prevented. Since the thread to be wound runs over the support roller in a winding process, i.e. is guided by a surface of the support roller, it is important that the surface of the support roller is not damaged.

A method is also proposed for winding a thread onto a bobbin tube to form a bobbin with a winding device as described above. The winding device has a machine frame and a controller and a support roller rotatably mounted in the machine frame and a winding mandrel. During the winding process, the bobbin abuts against the support roller and the winding mandrel is held on a pivot lever that is rotatably mounted in the machine frame. The pivot lever has a first holding arm having the winding mandrel and a second lever arm having a linear drive, wherein the linear drive is connected to the second lever arm using a push rod via an axle bolt and is held in the machine frame so as to be pivotable. A force measurement device is arranged between the axle bolt and the holder of the linear drive in the machine frame. Before the winding process, an empty bobbin tube is pushed onto the winding mandrel. Then the winding mandrel is pivoted by the linear drive using the pivot lever until the bobbin tube abuts against the support roller: An abutment force between the support roller and the bobbin tube is measured using the force measurement device and the pivot lever is moved using the linear drive by the controller until a specified abutment force is reached. During a winding cycle, the abutment force is advantageously regulated in a predetermined range by controlling the linear drive.

With the help of the force measurement device, a quantity is determined which, taking into account the technical conditions of the machine, is directly proportional to the abutment force. The abutment force between the bobbin or bobbin tube and the support roller is not measured directly, but rather the force with which the linear drive is supported against the machine frame is measured. A dead weight of the pivot lever together with any existing drive for the winding mandrel and the winding mandrel itself must be taken into account in their influence on the force measurement device. The resulting forces acting on the force measurement device change as the diameter of the bobbin increases due to the pivoting movement of the pivot lever and an associated change in the horizontal distance between the winding mandrel and its stationary rotary axis.

It is therefore advantageous if, after the bobbin tube has been pushed onto the winding mandrel, the winding mandrel with the empty bobbin tube is pivoted once for calibration. When the bobbin tube is empty, a calibration of this type must be repeated each time a different bobbin tube is used by upwardly pivoting the winding mandrel once. The controller can recognize the forces based on the pivoting movement and take them into account as a result. However, the force measured during the winding process is proportional to the abutment force due to the leverage effect and taking into account the corresponding corrections due to the technical conditions of the machine. The force measured in this way is determined by the weight of the bobbin and the pressing force of the bobbin on the support roller which is exerted by the pivot lever or the linear drive assigned thereto. When the diameter of the bobbin increases, the lever arm of the pivot lever on the bobbin side is pushed away from the support roller and is simultaneously held in its position, or at least its movement is hindered, by the opposite lever arm of the pivot lever by means of the linear drive. The regulation provided compares the measured force with a nominal value and corrects the position of the pivot lever based on a linear movement of the push rod so that the measured actual value of the force corresponds to a specified nominal value. Over an entire winding cycle, it can thus be achieved that the thread is always placed on the bobbin under the same contact pressure or under a contact pressure adapted to the winding cycle. Without a regulation of this type, increasingly more compressed thread layers would result on the bobbin over the winding cycle, which has a negative effect on later unwinding behavior in the subsequent processes for thread processing. Furthermore, the contact pressure can be reduced as the bobbin size increases, which has the advantage that the bobbin core is not pressed together by the outer layers. A high quality and uniformity of the bobbins produced can thus be achieved.

Due to the thread running up on the bobbin, the diameter of the bobbin increases continuously, which leads to a rotary movement of the pivot lever and thus also to a change in the load on the force measurement device. The controller determines this change via the force measurement and can restore the previous force relationships by moving the linear drive accordingly. When a predetermined bobbin diameter is reached, the winding is switched off. In addition, the current diameter of the bobbin is known at any time in the event of a fault in the winding operation by counting the steps of the linear drive, so that before resumption of operation, based on the diameter, a decision can be made whether the winding is to continue with the existing started bobbin or whether an exchange of the bobbin with an empty bobbin tube is advantageous.

Preferably, when reaching a specified bobbin diameter, winding is stopped and the bobbin is lifted off the support roller by the linear drive. The specified bobbin diameter can be determined in various ways. The length of the wound thread can be determined or calculated via the winding speed and thus the current bobbin diameter can be inferred. Furthermore, it is also possible to detect the deflection of the pivot lever or the movement of the linear drive by means of sensors and to deduce the bobbin diameter therefrom. The term "reaching a specified bobbin diameter" can thus also be understood as the specification of a specific thread length, duration of a winding, or movement of the linear drive or the degree of pivoting of the pivot lever. If the bobbin has been lifted off, it can be removed from the bobbin mandrel manually and/or with the aid of an automatic removal device afterwards, while the clamping device of the winding mandrel is released manually or automatically. In the raised state, the final weight of the finished bobbin can be determined by means of the force measurement device. After an empty bobbin tube has been pushed onto the winding mandrel and the tensioning device thereof, the pivot lever is moved by means of the linear drive until the bobbin tube abuts against the support roller and a specified abutment force is reached.

A winding machine or a rewinding machine is preferably equipped with a device as described above, which makes the machine itself easy to operate and inexpensive to manufacture.

BRIEF DESCRIPTION OF THE DRAWINGS

Further advantages of the invention are described in the following embodiment. In the drawings.

DETAILED DESCRIPTION

Figure 1:
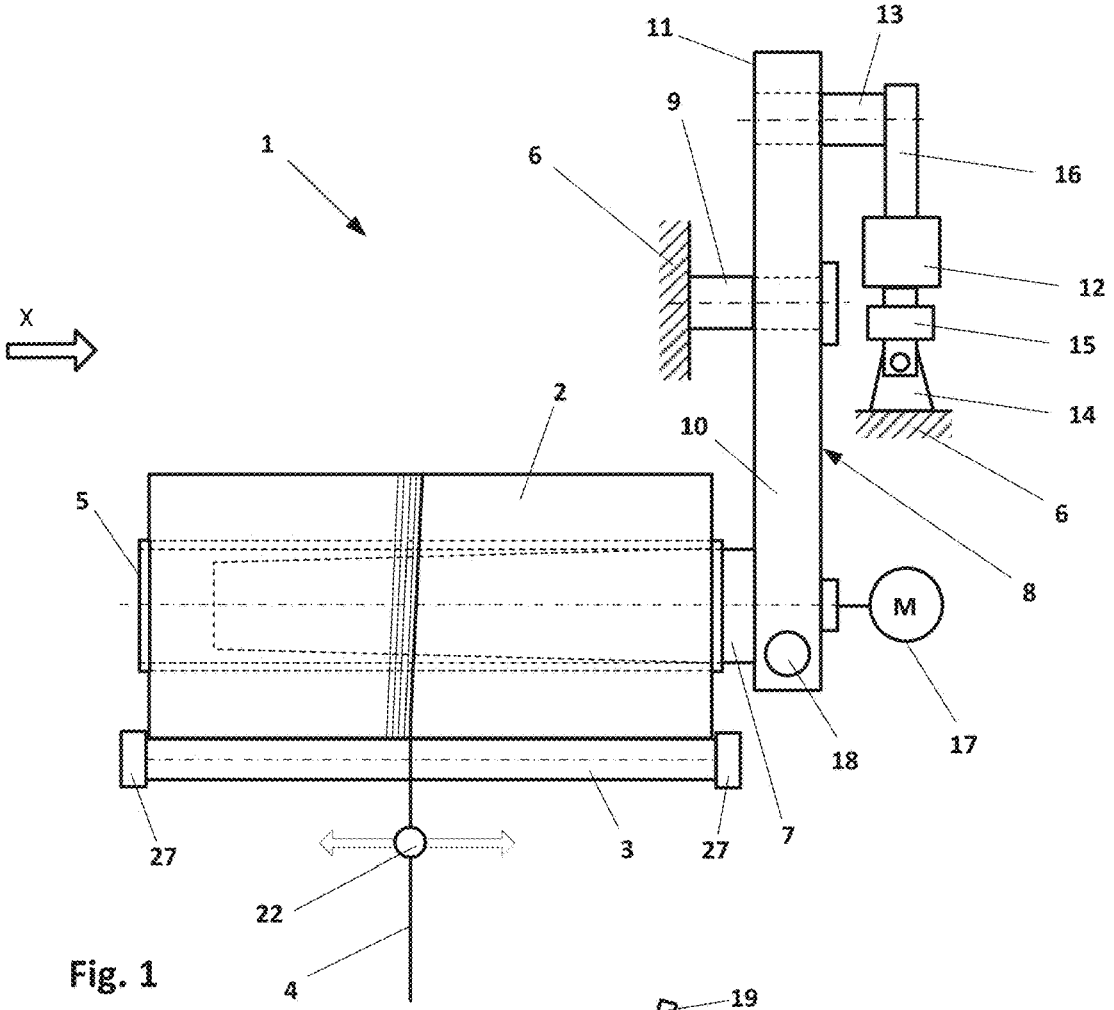
FIG. 1 is a schematic plan view of an embodiment of a winding device according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
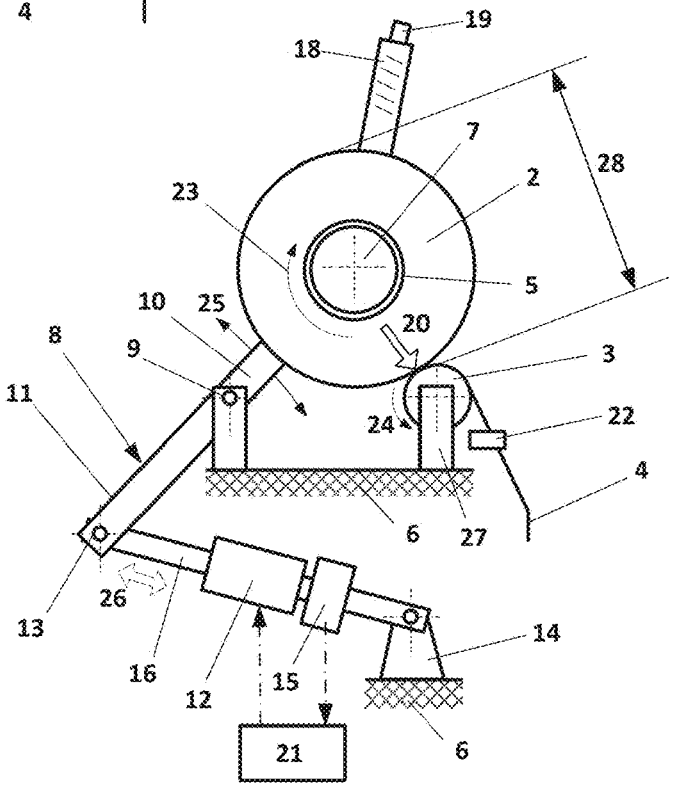
FIG. 2 is a schematic side view of the winding device in the direction X according to FIG. 1.

FIG. 1 shows a schematic plan view and FIG. 2 shows a schematic side view in the direction X of FIG. 1 of an embodiment of the winding device 1. The winding device 1 comprises a winding mandrel 7 which is rotatably mounted on a pivot lever 8. In the embodiment shown, the winding mandrel 7 is set in rotation by a drive 17 also held on the pivot lever 8. An alternative to this form of drive would be an indirect drive of the winding mandrel 7 via a support roller 3. A bobbin tube 5 is held non-rotatably on the winding mandrel 7 with the aid of a tensioning device (not shown). The clamping device of the winding mandrel 7 can be released via a release button 19 which is attached to a handle 18 on the pivot lever 8 when a full bobbin 2 and/or the bobbin tube 5 has to be changed. The pivot lever 8 is held in a fixed position in a rotary axis 9 on the machine frame 6. The pivot lever 8 consists of a first lever arm 10 and a second lever arm 11. The drive 17 of the winding mandrel 7 is attached to the first lever arm 10. A linear drive 12 is attached to the second lever arm 11 via an axle bolt 13. By connecting the linear drive 12 to the pivot lever 8 via the axle bolt 13 at an outer end of the second lever arm 11, the pivot lever 8 is rotated about the rotary axis 9 when the linear drive 12 moves, with the result that the distance between the winding mandrel 7 and the support roller 3 is changed. The linear drive 12 is connected to the axle bolt 13 via a push rod 16 and is rotatably attached to the machine frame 6 with a holder 14 on the side opposite the axle bolt 13. A force measurement device 15 is inserted between the holder 14 and the linear drive 12.

The support roller 3 is arranged parallel to the bobbin axis of the winding mandrel 7, against which the bobbin tube 5 abuts due to the pivoting movement 25 of the pivot lever 8 about the rotary axis 9. The support roller 3 is rotatably attached in the machine frame 6 by means of corresponding supports 27. By rotating the bobbin tube 5 in a corresponding direction of rotation 23, a thread 4 placed on the bobbin tube 5 is wound onto the bobbin tube 5 and a bobbin 2 is formed. In this case, the support roller 3 is also set into rotation in the corresponding direction of rotation 24 by abutting the bobbin 2 against the support roller 3. During this winding process, the so-called winding cycle, the thread 4 is moved back and forth along the bobbin axis of the bobbin tube 5 with a traverse 22. With the aid of this direction of movement of the traverse 22, different types of windings or bobbins 2 can be produced on the bobbin tube 5. As a result of the formation of a winding on the bobbin tube 5, the bobbin 2 increases in diameter 28, whereby the winding mandrel 7 and thus the first lever arm 10 of the pivot lever 8 is pivoted about the rotary axis 9, away from the support roller 3 due to the abutment against the support roller 3. During the winding process, the thread 4 is clamped between the bobbin tube 5 or the thread 4 already wound on the bobbin tube 5 and the support roller 3, so that it results in a tight-fitting winding on the bobbin tube 5. A clamping force or abutment force 20 applied in the process increases continuously during a winding process due to the dead weight of the increasing bobbin 2. In order to be able to ensure a constant clamping force, the linear drive 12 moves the second pivot arm 11 about the rotary axis 9 with a linear movement 26 and thereby lifts the bobbin 2 from the support roller 3 via the first lever arm 10. However, this lifting is only carried out to the extent that a predetermined clamping force remains between the bobbin 2 and the support roller 3. As a reaction to the clamping force and the lifting of the bobbin 2 by means of the linear drive 12, there is a change in the force applied to the force measurement device 15. The force measurement device 15 as well as the linear drive 12 are connected to a controller 21. The force measured with the force measurement device 15 is directly proportional to the abutment force 20 between the bobbin 2 and the support roller 3. The linear drive 12 can thus be set in motion by the controller 21 in accordance with a specified abutment force 20 and the abutment force 20 can be regulated to a constant value.

The present invention is not limited to the embodiments shown and described. Modifications within the scope of the claims are possible as well as a combination of the features, even if these are shown and described in different embodiments.

LIST OF REFERENCE SIGNS

1 Winding device
2 Bobbin
3 Support roller
4 Thread
5 Bobbin tube
6 Machine frame
7 Winding mandrel
8 Pivot lever
9 Rotary axis
10 First lever arm
11 Second lever arm
12 Linear drive
13 Axle bolt
14 Holder
15 Force measurement device
16 Push rod
17 Drive
18 Handle
19 Release button
20 Abutment force
21 Controller
22 Traverse
23 Direction of rotation of the bobbin
24 Direction of rotation of the support roller
25 Pivoting movement
26 Linear movement
27 Support support roller
28 Bobbin diameter

The invention claimed is:

1. A winding device for winding a thread onto a bobbin tube to form a bobbin, comprising:
- a machine frame;
- a controller;
- a support roller rotatably mounted in the machine frame for supporting the bobbin tube or the bobbin;
- a winding mandrel that holds the bobbin tube, the winding mandrel held on a pivot lever that is rotatably mounted on a rotary axis in the machine frame;
- the pivot lever comprising a first and a second lever arm, wherein the winding mandrel is provided on the first lever arm;
- a linear drive comprising a push rod connected directly to the second lever arm via an axle bolt, the linear drive pivotally attached to the machine frame via a holder; and
- a force measurement device arranged between the axle bolt and the holder, the force measurement device connected to the controller and configured to measure a force transmitted to the push rod directly from the second lever, the force proportional to an abutment force between the bobbin and the support roller; and
- wherein the controller is configured to provide continuous control of the linear drive and a stroke of the push rod based on an output of the force measurement device to maintain the abutment force at a specified value.

2. The winding device according to claim 1, wherein the force measurement device comprises a load cell.

3. The winding device according to claim 2, wherein the linear drive is connected to the holder via the load cell.

4. The winding device according to claim 1, wherein the linear drive comprises a stepping motor with a resolution of less than 0.06 mm per step.

5. The winding device according to claim 1, further comprising a drive for the winding mandrel arranged on the first lever arm.

6. The winding device according to claim 1, further comprising a handle having a release button to manually release the winding mandrel, the handle provided on the first lever arm.

7. The winding device according to claim 6, further comprising a stop provided on the pivot lever that prevents the winding mandrel from abutting against the support roller when the bobbin tube is absent.

8. A winding machine comprising the winding device according to claim 1.

9. A method of using a winding device to wind a thread onto a bobbin tube to form a bobbin, wherein the winding device includes:
- a machine frame;
- a controller;
- a support roller rotatably mounted in the machine frame, wherein the bobbin abuts against the support roller during a winding process;
- a winding mandrel held on a pivot lever that is rotatably mounted in the machine frame, the pivot lever having a first holding arm with the winding mandrel provided thereon, and a second lever arm;
- a linear drive having a push rod connected directly to the second lever arm via an axle bolt, the linear drive pivotally mounted to the machine frame via a holder; and a force measurement device arranged between the axle bolt and the holder, the force measurement device connected to the controller;

wherein the method comprises:

a) before the winding process, pushing an empty bobbin tube onto the winding mandrel;

b) pivoting the winding mandrel with the linear drive via the pivot lever until the bobbin tube abuts against the support roller;

c) using the force measurement device, measuring a force transmitted directly to the push rod from the second lever arm, the force corresponding to an abutment force between the support roller and the bobbin tube, wherein the abutment force changes as the bobbin changes in diameter during operation of the winding device; and d) with the controller, continuously controlling movement of the linear drive and a stroke of the push rod based on an output from the force measurement devise to maintain a specified abutment force.

10. The method according to claim 9, wherein after the bobbin tube has been pushed onto the winding mandrel, the winding mandrel with the empty bobbin tube is pivoted once for calibration.

11. The method according to claim 9, wherein during a winding cycle, the abutment force is regulated in a predetermined range by controlling the linear drive.

12. The method according to claim 9, wherein when a specified bobbin diameter is reached, winding is stopped, and the bobbin is lifted off the support roller by means of the linear drive.

* * * * *